US005676011A

United States Patent [19]

Allison

[11] Patent Number: 5,676,011

[45] Date of Patent: Oct. 14, 1997

[54] PRECIOUS METAL WIRE DRAWING APPARATUS

[76] Inventor: Jack Y. Allison, 220 W. Townsend, McAlester, Okla. 74501-2836

[21] Appl. No.: 649,356

[22] Filed: May 20, 1996

[51] Int. Cl.[6] ..... B21C 1/30

[52] U.S. Cl. ..... 72/290; 72/291; 254/120; 29/560.1

[58] Field of Search ..... 72/287, 290, 291, 72/282, 278, 274; 29/896.4, 896.41, 896.43, 560.1; 254/120, 243, 209, 211

[56] References Cited

U.S. PATENT DOCUMENTS

| | | | |
|---|---|---|---|
| 446,619 | 2/1891 | Burdon | 72/274 |
| 508,738 | 11/1893 | McCracken | 72/287 |
| 1,507,186 | 9/1924 | Judge | 254/120 |
| 3,431,766 | 3/1969 | Deardorff | 72/287 |
| 4,475,716 | 10/1984 | Jarmin | 72/447 |
| 5,255,551 | 10/1993 | Vetter | 72/290 |

FOREIGN PATENT DOCUMENTS

| | | | |
|---|---|---|---|
| 2504557 | 8/1976 | Germany | 72/287 |
| 11261 | 1/1905 | United Kingdom | 72/287 |

*Primary Examiner*—Daniel C. Crane
*Attorney, Agent, or Firm*—Robert K. Rhea

[57] ABSTRACT

Wire drawing apparatus for ease in manually drawing precious metal wire is formed by an elongated base having a forward end portion transversely supporting a draw plate through which wire stock may be drawn and a downturned rearward end portion having a pivotally connected upstanding lever moveable at its upper end portion toward and away from the draw plate by pivoting about a horizontal axis. A wire grip for grasping wire dawn trough the draw plate is attached to the lever by a link chain extending through a keyhole slot in the depending end portion of the lever for edgewise nesting one link of the chain prior to manually moving the lever in a direction opposite the draw plate.

6 Claims, 1 Drawing Sheet

PRECIOUS METAL WIRE DRAWING APPARATUS

This invention relates to jewelry fabrication and more particularly to drawing precious metal wire.

BACKGROUND OF THE INVENTION

1. Field of the Invention

In the fabrication of jewelry, it is frequently necessary to reduce the diameter of wire being used, such as gold or silver. This is presently accomplished by utilizing a jeweler's wire drawing plate having a series of transverse graduated size holes through which the wire is manually pulled in a wire drawing action which is time consuming and stressful.

2. Description of the Prior Art

U.S. Pat. No. 5,255,551 issued Oct. 26, 1993 to Vetter for PRECIOUS METAL WIRE DRAWING MACHINE AND METHOD discloses a motorized precious metal wire drawing machine. A wire-end clasp plate for gripping a wire being drawn is slidably mounted on a pair of parallel rods extending between a draw plate and a motor mount block. A threaded hole in the clasp plate threadedly surrounds a motor driven shaft interposed between the support rods which, when angularly rotated, moves the support plate toward the motor by operation of the latter and draws wire through the draw plate.

U.S. Pat. No. 3,431,766 issued Mar. 11, 1969 to Deardorff for DEVICE FOR DRAWING WIRE WHICH ELIMINATES CHATTER discloses a wire to be drawn held at one end by pliers. The opposite end portion of the wire passes over a cam from a die vertically reciprocated toward and away from the cam opposite the position of the pliers. The cam is moveable at one end portion toward a cam follower to impinge the wire at the plier held end portion whereby further movement of the die draws the wire a limited distance, and when the die is moved toward the pliers, the wire is drawn over the cam and the cycle repeated.

This invention is believed distinctive over these and similar patents by providing a lever manually moved toward and away from a wire drawing plate with the lever gripping a drawn end portion of the wire and pulling it through the draw plate on each pivoting action of the lever.

SUMMARY OF THE INVENTION

An elongated generally horizontally disposed base vertically supports a wire draw plate at one end and pivotally supports, at its other end, the depending end portion of an elongated generally upright handle for vertical pivoting movement about a horizontal axis of the other end portion of the handle toward and away from the draw plate. Adjacent the pivotally connected end, the handle is provided with a transverse chain link gripping aperture. A wire end clasping member grips one end of a wire to be drawn extending through the draw plate. An elongated chain connected with the clasp member projects through the chain link gripping aperture of the handle whereby manually pivoting the handle from a position inclined toward the draw plate, draws a length of the wire through the draw plate for one cycle of operation.

The principal object of this invention is to provide a manually operated apparatus which will quickly and easily draw successive lengths of precious metal wire.

DESCRIPTION OF THE PREFERRED EMBODIMENTS

Figure 1:
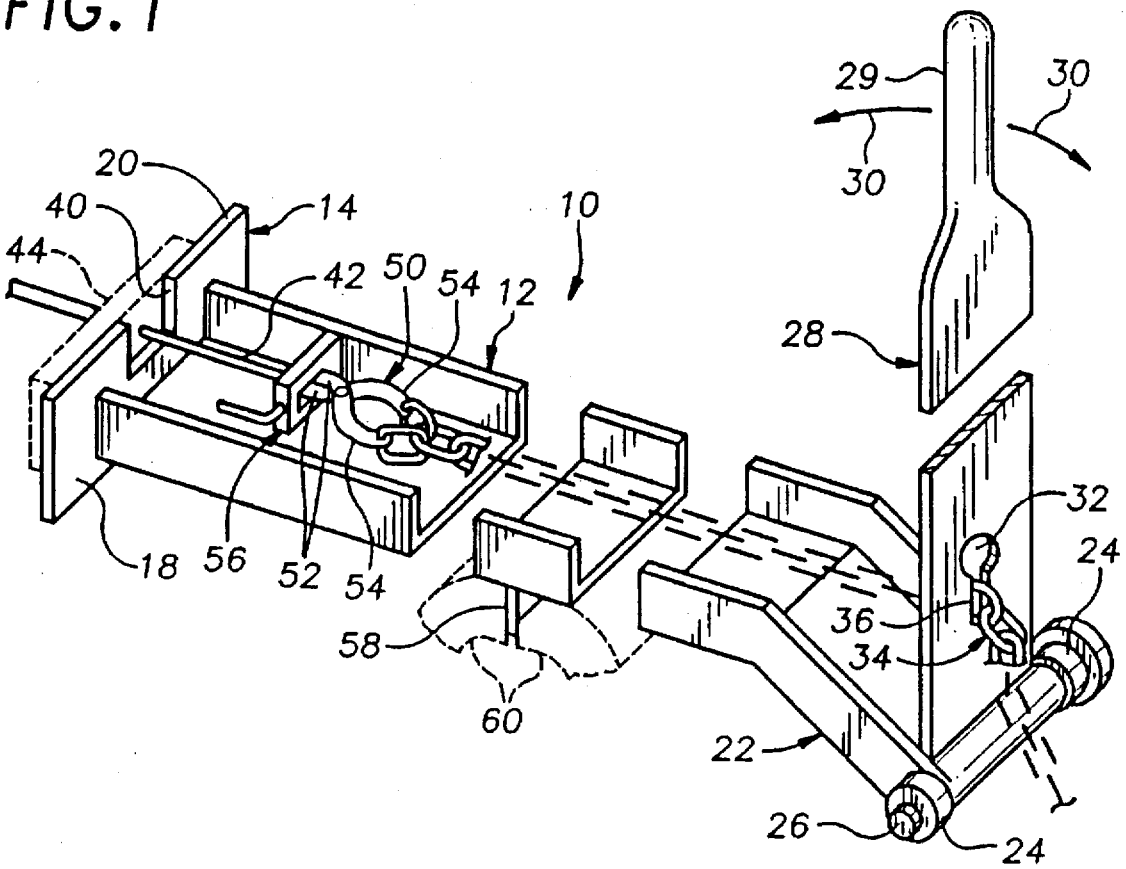
FIG. 1 is a fragmentary isometric view of the apparatus in operative position; and, FIG. 2 is a fragmentary isometric view, to a larger scale, of the draw plate end portion of the apparatus.
Figure 2:
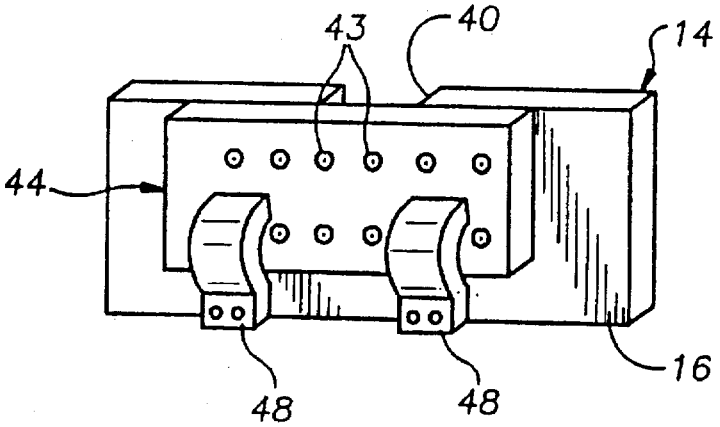

Like characters of reference designate like parts in those figures of the drawings in which they occur.

In the drawings:

The reference numeral 10 indicates the apparatus as a whole comprising a generally horizontal channel like base member 12 having a transverse draw plate support 14 at its forward end portion, the plate having forward and rearward planar surfaces 16 and 18 and a top surface 20. The rearward end portion of the base 12 angularly extends longitudinally downward and outward from the plate 14 as at 22. A pair of line drilled lugs 24 are transversely secured to opposite sides of the down turned end 22 of the base for receiving an elongated pin 26 which journals the depending end portion of a generally upright elongated lever 28, having a handle 29, for vertical pivoting movement about the horizontal axis of the pin 26 in the direction of the arrows 30. Adjacent its depending pivoted end portion, the lever 28 is provided with a keyhole-like slot opening defined by a top circular portion 32 dimensioned, for free sliding movement of the links of a chain 34 therethrough, and a depending narrow slot-like portion 36 intersecting the circular portion for gripping a vertically edgewise disposed link of the chain 34 when disposed therein for the purposes presently explained.

The plate support 14 is provided with an upwardly open U-shaped recess 40 in its top surface 20 which freely receives the drawn end portion of a wire 42 passing through one of a series of die holes 43 in a draw plate 44. The draw plate 44 flatly contacts the forward surface 16 of the plate 14 and is gripped by spring means such as clips 48 secured to the forward surface 16 of the plate 14.

A wire grip means 50 is connected at one end portion with the wire being drawn 42, and is connected at its other end portion to the forward end portion of the chain 34. The grip means 50 is plier-like in general configuration, and includes a pair of gripping jaws 52 forced toward each other by handle members 54 connected to the chain 34 and similarly biased together by tension on the chain as presently explained.

The jaws 52 are further secured in wire 42 gripping relation by a clamp member 56. Obviously, a toggle link secured plier-like member, presently marketed under the trademark Vise Grip, may be used if desired, for gripping the wire 42.

The base member 12 further includes a depending plate-like transverse member 58 to be gripped between the jaws 60 of a vise, not shown, for rigidly supporting the base 12.

Operation

In operation, assuming the apparatus 10 is arranged as described hereinabove and supported by vise jaws with the wire drawn end portion 42 projecting through the draw plate 44 and clamped by the grip means 50. The handle 30 is disposed in a forward direction and the chain 34 is manually positioned tautly with one of its links disposed edgewise in the slot 36 of the keyhole opening. The lever is manually moved by its handle 29 in a rearward direction, which draws the wire through the draw plate 44 die opening 43, completing one cycle of operation.

Obviously the invention is susceptible to changes or alterations without defeating its practicability. Therefore, I do not wish to be confined to the preferred embodiment shown in the drawings and described herein.

I claim:

1. A wire drawing apparatus, comprising:

an elongated generally horizontally disposed channel-like base having a forward end and having its opposite end portion longitudinally inclined downward;

a generally upright elongated lever pivotally connected at its depending end portion with the downwardly inclined end portion of said base for manual vertical pivoting movement of its upper end portion about a horizontal axis toward and away from the base forward end;

a draw plate through which wire stock may be drawn supported by the forward end of said base;

wire grip means for grasping wire drawn through said draw plate; and, link chain means connecting said grip means with said lever for drawing wire by pivoting movement of said lever in a direction opposite the draw plate.

2. The wire drawing apparatus according to claim 1 in which said lever is provided with a keyhole shaped opening in its pivotally connected end portion for edgewise nesting individual links of said chain means.

3. The wire drawing apparatus according to claim 2 and further including:

a planar draw plate support transversely secured to the forward end of said base, said draw plate support having an upwardly open transverse recess surrounding a portion of a wire being drawn.

4. The wire drawing apparatus according to claim 3 and further including:

spring means on said draw plate support for securing said draw plate to the draw plate support.

5. The wire drawing apparatus according to claim 4 in which the wire grip means comprises:

pivotally connected plier-like jaws and handle members respectively moveable toward each other by tension applied to said chain means by said lever.

6. The wire drawing apparatus according to claim 1 in which the wire grip means comprises:

pivotally connected plier-like jaws and handle members respectively moveable toward each other by tension applied to said chain means by said lever.

* * * * *